US009869125B2

(12) United States Patent
Simpson et al.

(10) Patent No.: US 9,869,125 B2
(45) Date of Patent: Jan. 16, 2018

(54) LATCH FOR LADDER OR STEP STOOL

(71) Applicant: Tricam Industries, Inc., Eden Prairie, MN (US)

(72) Inventors: Dennis D. Simpson, Plymouth, MN (US); Yongxue Lu, Shanghai (CN)

(73) Assignee: Tricam Industries, Inc., Eden Praire, MN (US)

( * ) Notice: Subject to any disclaimer, the term of this patent is extended or adjusted under 35 U.S.C. 154(b) by 0 days.

(21) Appl. No.: 15/146,573

(22) Filed: May 4, 2016

(65) Prior Publication Data

US 2017/0321482 A1 Nov. 9, 2017

(51) Int. Cl.

| | |
|---|---|
| ***E06C 1/387*** | (2006.01) |
| ***E06C 1/16*** | (2006.01) |
| ***E06C 7/12*** | (2006.01) |
| ***E06C 1/14*** | (2006.01) |

(52) U.S. Cl.

CPC ..... *E06C 1/387* (2013.01); *E06C 1/14* (2013.01); *E06C 1/16* (2013.01); *E06C 7/12* (2013.01)

(58) Field of Classification Search

CPC ..... E06C 1/16; E06C 1/387

See application file for complete search history.

(56) References Cited

U.S. PATENT DOCUMENTS 3,739,876 A * 6/1973 Goldberg ..... E06C 1/39 182/155
4,320,817 A * 3/1982 Knoke ..... A47C 12/02 182/126
4,485,892 A 12/1984 Maloney et al.
5,722,507 A 3/1998 Kain
5,762,163 A 6/1998 Kain
5,992,567 A * 11/1999 Chiu ..... E06C 1/387 182/161
6,012,548 A * 1/2000 Kim ..... E06C 1/387 182/156
6,390,237 B1 * 5/2002 Kim ..... E06C 1/387 182/129
6,550,579 B2 * 4/2003 Gibson ..... E06C 1/387 182/161

(Continued)

FOREIGN PATENT DOCUMENTS

| | | | | |
|---|---|---|---|---|
| GB | 2322897 A * | 9/1998 | ..... | E06C 1/393 |
| JP | 2002138782 A * | 5/2002 | ..... | E06C 1/387 |
| WO | WO 0042286 A1 * | 7/2000 | ..... | E06C 1/387 |

*Primary Examiner* — Katherine W Mitchell
*Assistant Examiner* — Marcus Menezes
(74) *Attorney, Agent, or Firm* — Patterson Thuente Pedersen, P.A.

(57) ABSTRACT

A step stool or ladder includes a latch that engages a cross member to prevent a step from disengaging from the cross member. The curved end of the latch has a tail that provides additional weight to the end of the latch that engages the cross member and allows for decreased tolerances in manufacturing the latch. The other end of the latch has a knob that extends through an opening in the step so that the latch is accessible and to give visual cues to the user. The knob also maintains the latch in its position in the opening in the step. A bent out portion of the latch midsection serves to limit the amount of travel between the knob and the bent portion. The latch rotates on the portion of the latch between the bent portion and travel limiter and the knob attached to the latch.

18 Claims, 8 Drawing Sheets

(56) References Cited

U.S. PATENT DOCUMENTS

| | | | | |
|---|---|---|---|---|
| 7,963,369 | B2 * | 6/2011 | Parker | E06C 1/387 182/161 |
| 8,997,931 | B2 * | 4/2015 | Parker | E06C 1/383 182/116 |
| 2003/0057019 | A1 * | 3/2003 | Schmitt | E06C 1/39 182/18 |
| 2005/0029050 | A1 * | 2/2005 | Baumgartner | E06C 1/393 182/165 |
| 2011/0024234 | A1 * | 2/2011 | Lin | E06C 1/387 182/161 |

* cited by examiner

LATCH FOR LADDER OR STEP STOOL

FIELD OF THE INVENTION

This invention relates generally to ladders and step stools, more specifically to latches for ladders and step stools adapted to lock ladders and step stools in the use position.

BACKGROUND OF THE INVENTION

Previously, ladders have been made with little concern for basic safety. Standards have now been implemented that require a constraint which prevents the user from accidentally folding a ladder or step stool during use. The constraint must prevent an unintended fold up or collapse of the ladder or step stool. Such an unintended folding up of the ladder or step stool can result from a user running up to a ladder or walking briskly onto the ladder. The sideways force of the user can cause the ladder or step stool to fold or collapse. In other instances, the user may move to one side or the other and the resultant forces could cause the ladder to collapse or prematurely fold. The results can be very devastating. The user may fall and become injured. The items attached to the ladder or step stool may spill or fall. The items being carried by the user may also spill and fall causing further damage.

Several step stools and ladders now are provided with latches or other constraints. Some latches are for locking a bifurcated step into one of two positions. U.S. Pat. No. 4,485,892 teaches a locking mechanism for a platform stool which is used to lock a bifurcated step into one of two positions. U.S. Pat. No. 5,722,507 teaches a locking mechanism for a ladder which is used to lock a step into one of two positions. U.S. Pat. No. 5,762,163 also teaches locking mechanism for a step stool which is used to lock a bifurcated step into one of two positions. Both U.S. Pat. Nos. 5,722,507 and 5,762,163 are assigned to Cosco, Inc. of Columbus, Ind.

Some latches are for prevention of the collapse or premature folding of a ladder or step stool. The locking mechanisms shown are generally difficult to use. The latches are located below a step on the step stool or ladder and are generally not visible to the user. The user may unfold the step stool or ladder which may engage the lock or latch. However, since the latches or locks are hidden from view folding the ladder or step stool back into its collapsed or storage position may be a problem. Since the lock is not visible, users may become frustrated when trying to fold the ladder or step stool. Sometimes users feel the step stool or ladder is broken and resort to brute force to forcibly fold the step stool or ladder. This ruins the ladder or step stool or causes a loss in the structural integrity of the unit.

U.S. Pat. No. 6,390,237 was a significant improvement in latch design that prevents premature or undesirable folding. That patent also disclosed a latch that is readily visible when the ladder is in use and a ladder or step stool that is easy to store within the house. However, the latch of U.S. Pat. No. 6,390,237 required very tight tolerances in the manufacture of the ladder or step stool to function properly.

What is needed is an improved latch for a ladder or step stool that improves the operability of the mechanism while allowing for decreased tolerances during manufacture of the ladder or step stool.

SUMMARY OF THE INVENTION

The disclosed ladder or step stool has a first frame member and a second frame member. The second frame member folds to a position within the confines of the first frame member to provide a thin, easily stored ladder for use within a household. The first frame member includes a safety hoop at which the user can easily grab while on the step or rung of the ladder or step stool. The frame also includes a cross member which spans a portion of one of the frame members. The ladder or step stool has one or more steps. At least one of the steps is supported primarily by the cross member in its unfolded position in which a user can ascend on the steps of the stool or ladder. One or more other steps may be attached to the step which is primarily supported by the cross member.

The step that is primarily supported by the cross member includes a latch that has a first curved end which engages the cross member to prevent the step primarily supported by the cross member from disengaging the cross member. The latch has a curved end which engages the cross member. The other end of the latch extends through an opening in the step so that the latch is accessible and visible to the user. The end passing through the opening in the step is provided with a knob that gives further visual cues to the user. The knob also maintains the latch in its position in the opening in the step. The latch rotates on the portion of the latch between the bent portion and the knob attached to the latch. The curved end of the latch includes a tail, which serves to weigh and position the curved end to better engage the cross member. The tail allows for improved operation while decreasing the tolerances necessary during manufacturing.

In use, the latch is spaced so that it will engage the cross member with a normal gravitational force. The curved end slips over the cross member. By pushing down on the knob accessible on the outside of the step, the curved end of the latch disengages the cross member. Advantageously, the latch is visible by the user and the knob is provided with a simple written instruction so that the use of the latch is more intuitive. This prevents the user from becoming frustrated and forcibly trying to close the ladder.

The improved latch includes a tail to add weight to the engagement portion of the latch, which improves functioning of the latch while allowing for decreased tolerances in the manufacturing of the ladder or step stool.

BRIEF DESCRIPTION OF THE DRAWINGS

The invention may be more completely understood in consideration of the following detailed description of various embodiments of the invention in connection with the accompanying drawings, in which.

Figure 1:
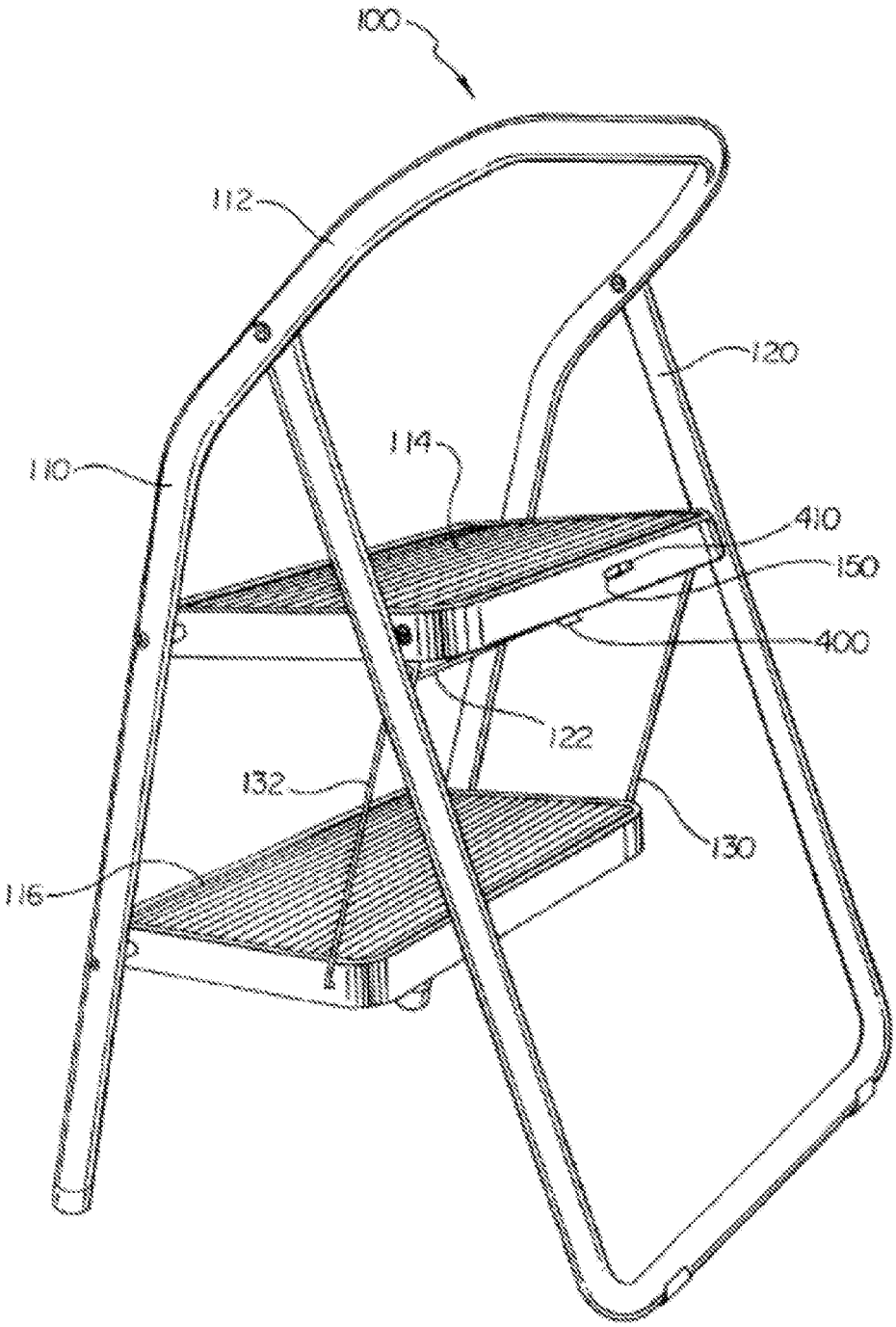
Fig. 1 Prior Art
FIG. 1 is a perspective view of a step stool which uses a prior art latch.

While the present invention is amenable to various modifications and alternative forms, specifics thereof have been shown by way of example in the drawings and will be described in detail. It should be understood, however, that the intention is not to limit the present invention to the particular embodiments described. On the contrary, the intention is to cover all modifications, equivalents, and alternatives falling within the spirit and scope of the present invention.

DETAILED DESCRIPTION OF THE DRAWINGS

Attached are drawings of an embodiment of the hinged tray of the present invention as well as detailed drawings of the individual components of the hinged tray. It is understood that the various components disclosed in the drawings may be substituted with equivalent components and are not considered limiting.

The following detailed description should be read with reference to the drawings in which similar elements in different drawings are numbered the same. The accompanying figures depict embodiments of the hinged tray of the present invention, and features and components thereof. Any references to front and back, right and left, top and bottom, upper and lower, and horizontal and vertical are intended for convenience of description, not to limit the present invention or its components to any one positional or spatial orientation. The drawings, which are not necessarily to scale, depict illustrative embodiments and are also not intended to limit the scope of the invention. Any reference in the claims to a "ladder" is not intended to limit the scope of the invention to a specific type of ladder, but to any type of ladder including ladders, step ladders, step stools, podium ladders, etc.

In the following detailed description of the preferred embodiment, reference is made to the accompanying drawings which form a part hereof, and in which are shown by way of illustration specific embodiments in which the invention may be practiced. It is to be understood that other embodiments may be utilized and structural changes may be made without departing from the scope of the present invention.

FIG. 1 shows a step stool of the prior art 100. The step stool 100 has a first frame member 110 and a second frame member 120. The first frame member 110 includes a safety hoop 112 which the user can easily grab while on the step or rung of the step stool 100. The step stool 100 includes two rungs or steps 114 and 116 which are pivotally attached to the first frame member 110. The step 114 folds onto a cross member 122. The cross member 122 supports the step 114. The remaining step 116 is attached to a first rod 130 and a second rod 132. The remaining step is supported by the rods 130 and 132.

Step 114 is the step that is primarily supported by the cross member 122. Step 114 includes an opening 150 therein. A latch 400 fits within the opening 150. The latch engages the cross member 122 to prevent the step stool from folding or collapsing unexpectedly during use. It should be noted that this latch is not limited to use in a step stool. The latch 400 could also be used in a ladder with a similar step and cross member in the frame. The step stool 100 is used as an example of a ladder or stool that has a step with a latching mechanism 400.

Figure 2:
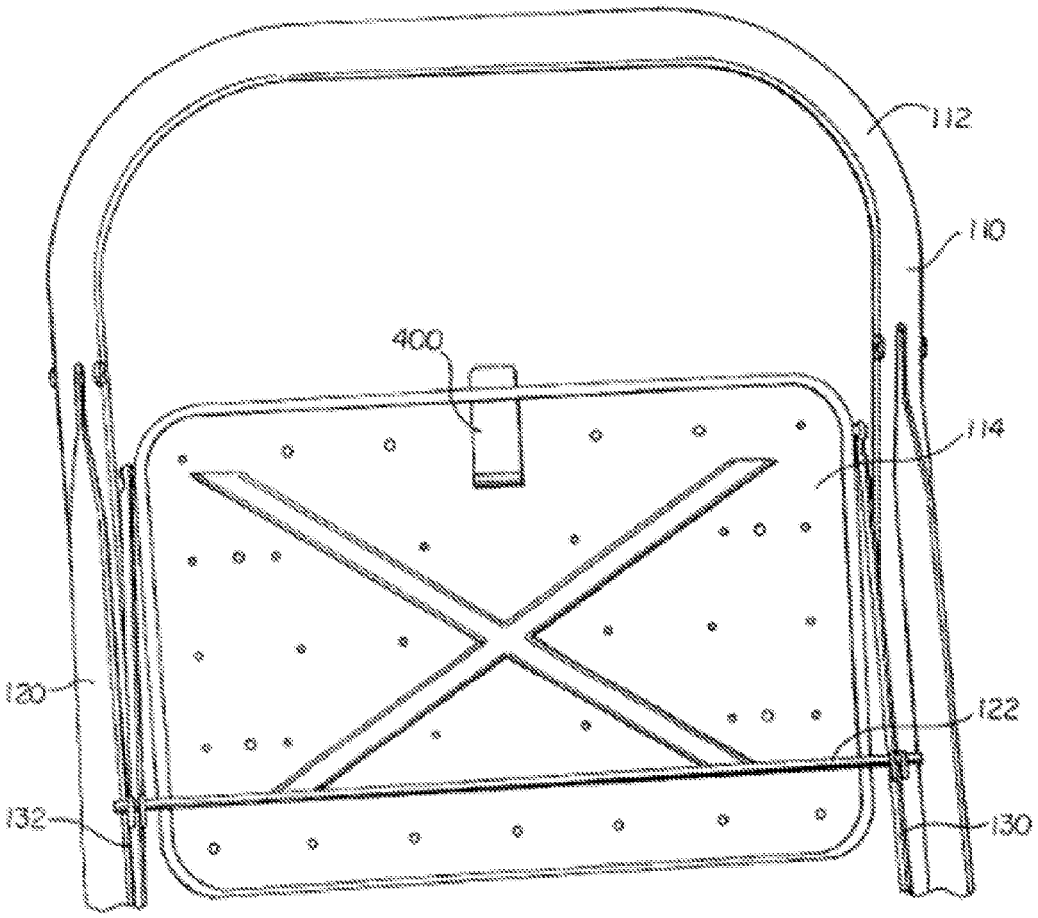
Fig. 2 Prior Art
FIG. 2 is a view of the prior art latch and the step of the step stool when the step stool is in a folded position for storage.

FIG. 2 is a view of a prior art latch and the step of the step stool when the step stool is in a folded position for storage. As can be seen, the latch 400 extends through an opening 150 in the back edge 115 of the step 114. The latch 400 includes a knob 410 which is attached at one end of the latch 400.

Figure 3:
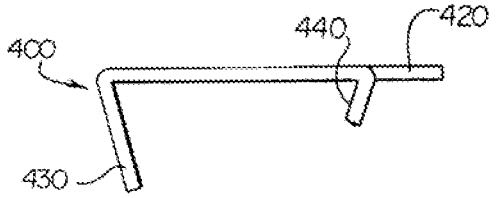
Fig. 3 Prior Art
FIG. 3 is a side view of the prior art latch.
Figure 4:
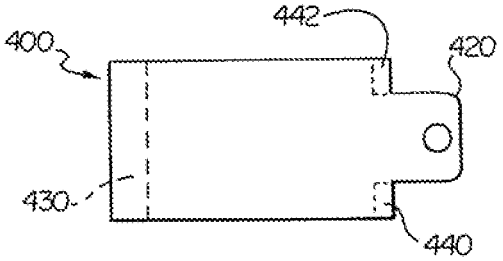
Fig. 4 Prior Art
FIG. 4 is a top view of the prior art latch shown in FIG. 4.
Figure 5:
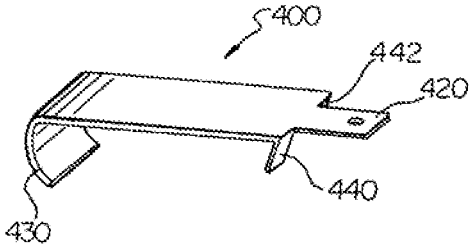
Fig. 5 Prior Art
FIG. 5 is a perspective view of the prior art latch without the knob.
Figure 6:
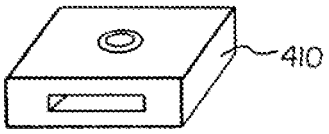
Fig. 6 Prior Art
FIG. 6 is a perspective view of the knob that attaches to the prior art latch.

FIGS. 3-6 detail the prior art latch 400. FIG. 3 is a side view of the prior art latch 400. FIG. 4 is a top view of the prior art latch shown in FIG. 3. FIG. 5 is a perspective view of the prior art latch 400. FIG. 6 is a perspective view of the knob that attaches to the prior art latch.

The latch 400 includes a first end 420 and a second end 430. The latch 400 starts from a flat piece of sheet metal. The second end 430 is formed or bent to form a hook which is capable of engaging the cross member 122 of the frame member 120 of the step stool 100 or ladder. The first end 420 is narrower than the main body of the latch 400. The first end 420 is adapted to receive the knob 410 (shown in detail in FIG. 6). Intermediate the first end 420 and the second end 430 is a first tab 440 and a second tab 442. The tabs 440 and 442 serve to limit the distance that the first end 420 can be inserted into the opening 150 in the step 114 of the step stool 100. The tabs 440 and 442 are positioned near the first end 420 in the embodiment shown.

FIG. 5 shows the latch 400 in a perspective view. The latch 400 shown in FIG. 5 has a second end 430 which is slightly more curved than the latch shown in FIG. 3.

Figure 7:
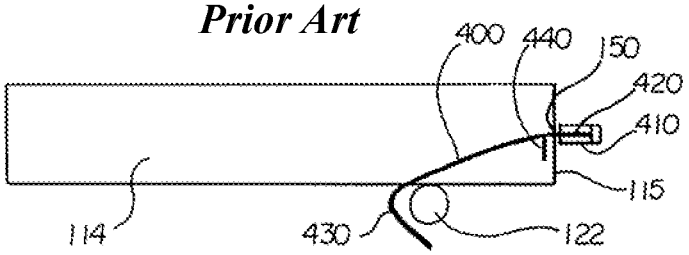
Fig. 7 Prior Art
FIG. 7 is a side view of the step, prior art latch and cross member of the step stool.

FIG. 7 is a cut away side view of the prior art step 114. The step 114 is cut away and shows the latch 400 engaged with the cross member 122. Frame members 110 and 120 are eliminated from this view for the sake of clarity. FIG. 7 therefore is a side view of the step 114, the latch 400 and the cross member 122 of the step stool 100. The operation of the latch will now be discussed. When the step 114 is folded into a position where the step 114 is supported by the cross member 122, the latch 400 drops over the cross member 122 or engages the cross member 122. Pulling up on the step 114 cannot be accomplished since the latch 400, and more specifically the second end 430 of the latch, is engaged with the cross member 122. The knob 410 is placed over the first end 420 after the first end 420 has been passed through the opening 150. The knob 410 and the tabs 440 and 442 serve to limit the amount of travel through which the latch can pass. The portion of the latch between the knob 410 and the tabs 440 and 442 is the pivot point of the latch. The latch 400 pivots on the edge of the opening 150.

After the latch is engaged with the cross member 122 the latch can be disengaged by pushing down on the knob 410 causing the second end of the latch to disengage from the cross member 122. After the latch is disengaged from the cross member 122 the step stool or ladder 100 can be folded into its storage position. The latch knob 410 is typically provided with brief printed instructions which make the operation of the latch more intuitive. For example, the latch knob 410 may carry a designation of push and an arrow. Advantageously, the latch knob and the latch are on the back edge 115 of the step 114. This is advantageous since the user can see how to disengage the latch and doesn't have to reach underneath the step 114 in order to unlatch the step and the ladder. This eliminates or greatly reduces the frustration associated with folding up the ladder and disengaging the latch 400.

Figure 8:
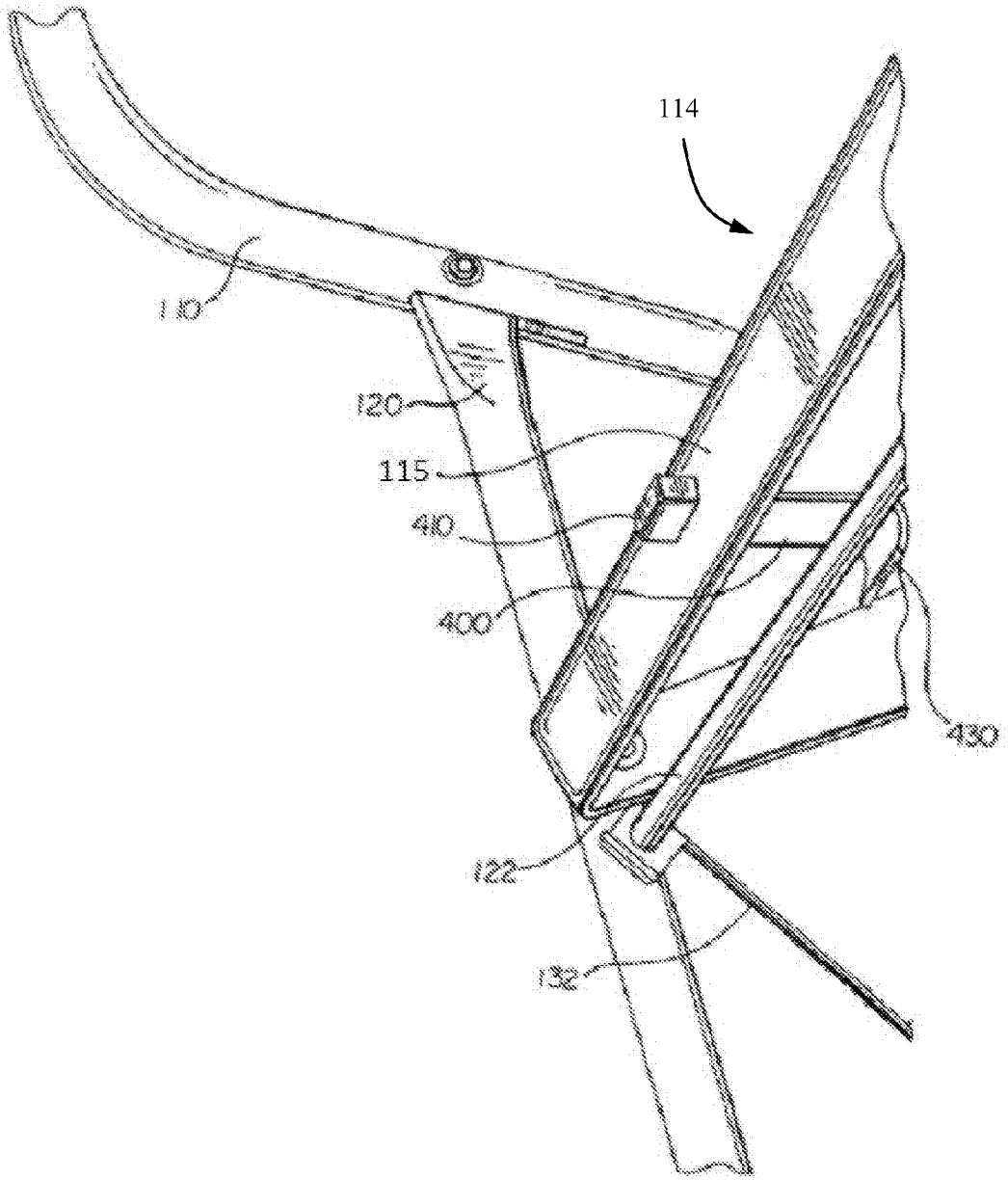
Fig. 8 Prior Art
FIG. 8 is a view of the prior art latch engaged with the step where the latch is engaged with the cross member of the frame of the step stool.
Figure 9:
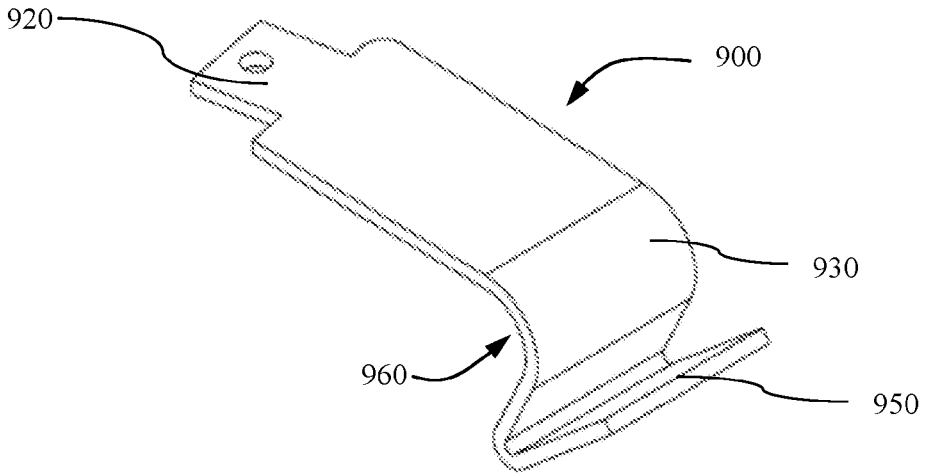
FIG. 9 is a perspective view of the latch of the present invention.
Figure 10:
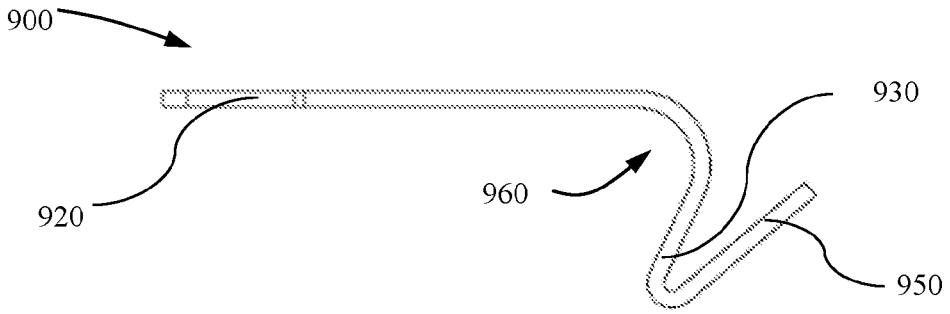
FIG. 10 is a side view of the latch shown in FIG. 9.
Figure 11:
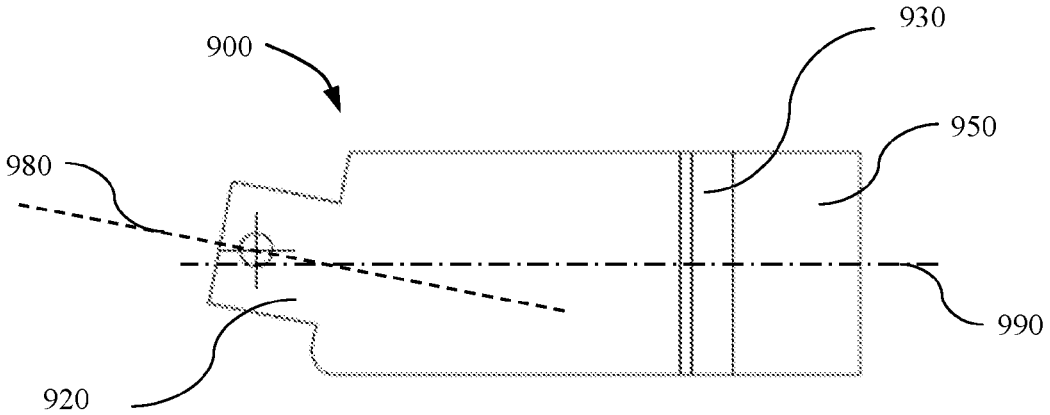
FIG. 11 is a top view of the latch shown in FIG. 9

FIG. 8 is a view of a prior art latch engaged with the step where the latch is engaged with the cross member of the frame of the step stool. FIG. 8 is a view of a latch 400 engaged with the step 114 where the latch 400 is engaged with the cross member 122 of the frame of the step stool 100. The view shown in FIG. 8 is from the bottom on a normally orientated step stool 100.

Advantageously, the latch is spaced so that it will engage the cross member with a normal gravitational force. The curved end slips over the cross member. The knob is accessible on the exterior back edge of the step. By pushing down on the knob on the outside or exterior of the step, the curved end of the latch disengages the cross member. Advantageously, the latch is visible by the user and the knob is provided with a simple written instruction so that the use of the latch is more intuitive. This prevents the user from becoming frustrated and forcibly trying to close the ladder.

Figure 12:
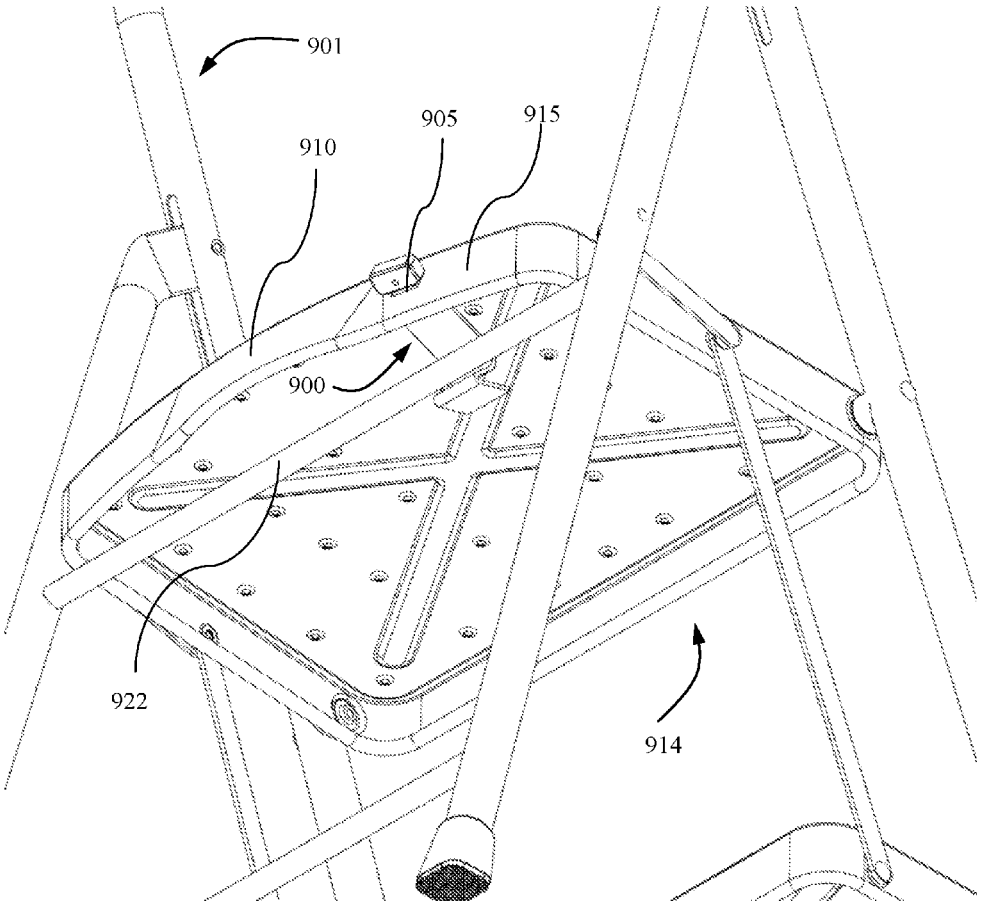
FIG. 12 is a perspective view of the underside of a step stool including the latch of the present invention in the latched position and a step provided with a handle of the present invention.
Figure 13:
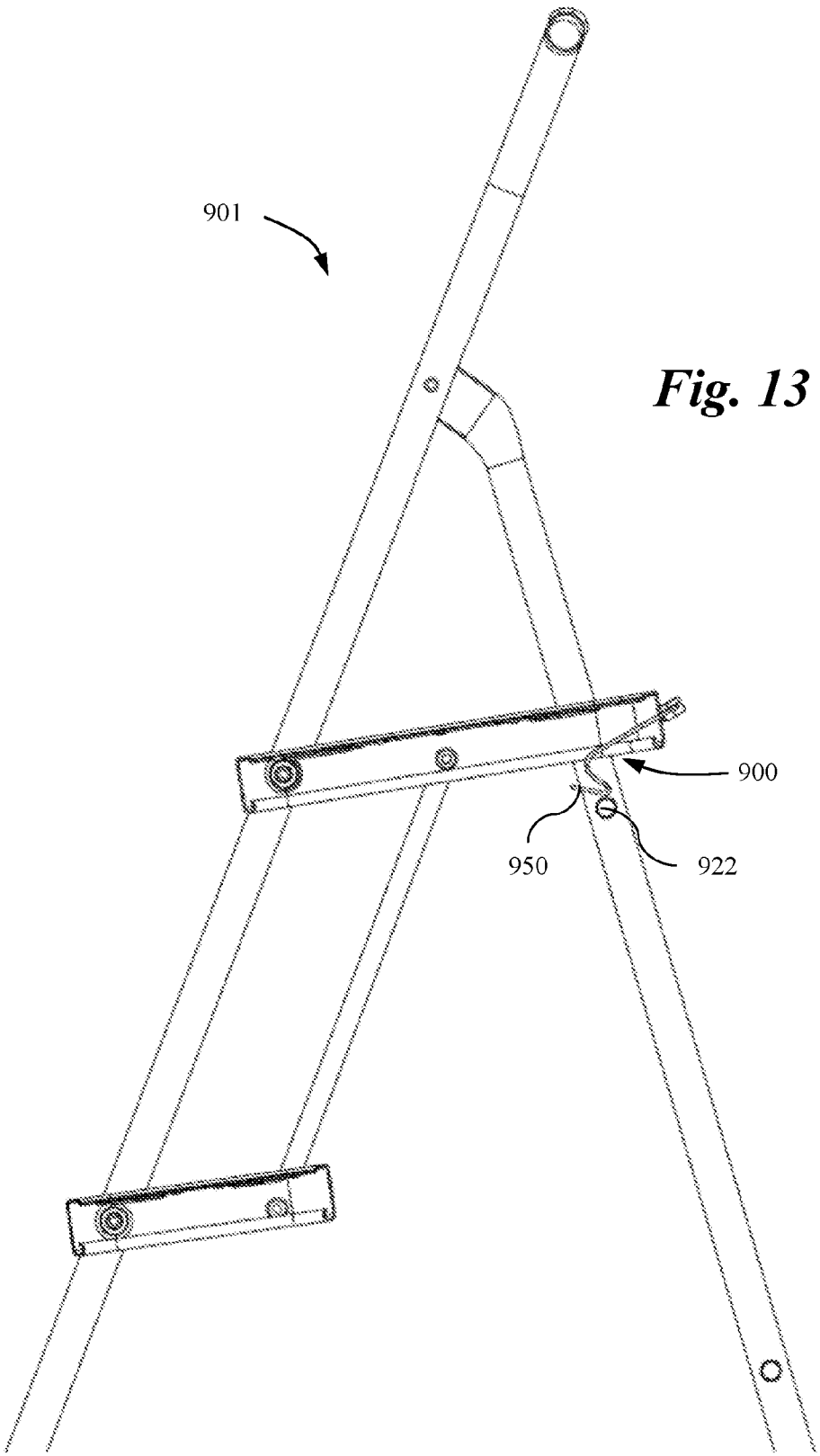
FIG. 13 is a side view of a step stool including the latch of the present invention showing the latch as it begins engaging the cross member.
Figure 14:
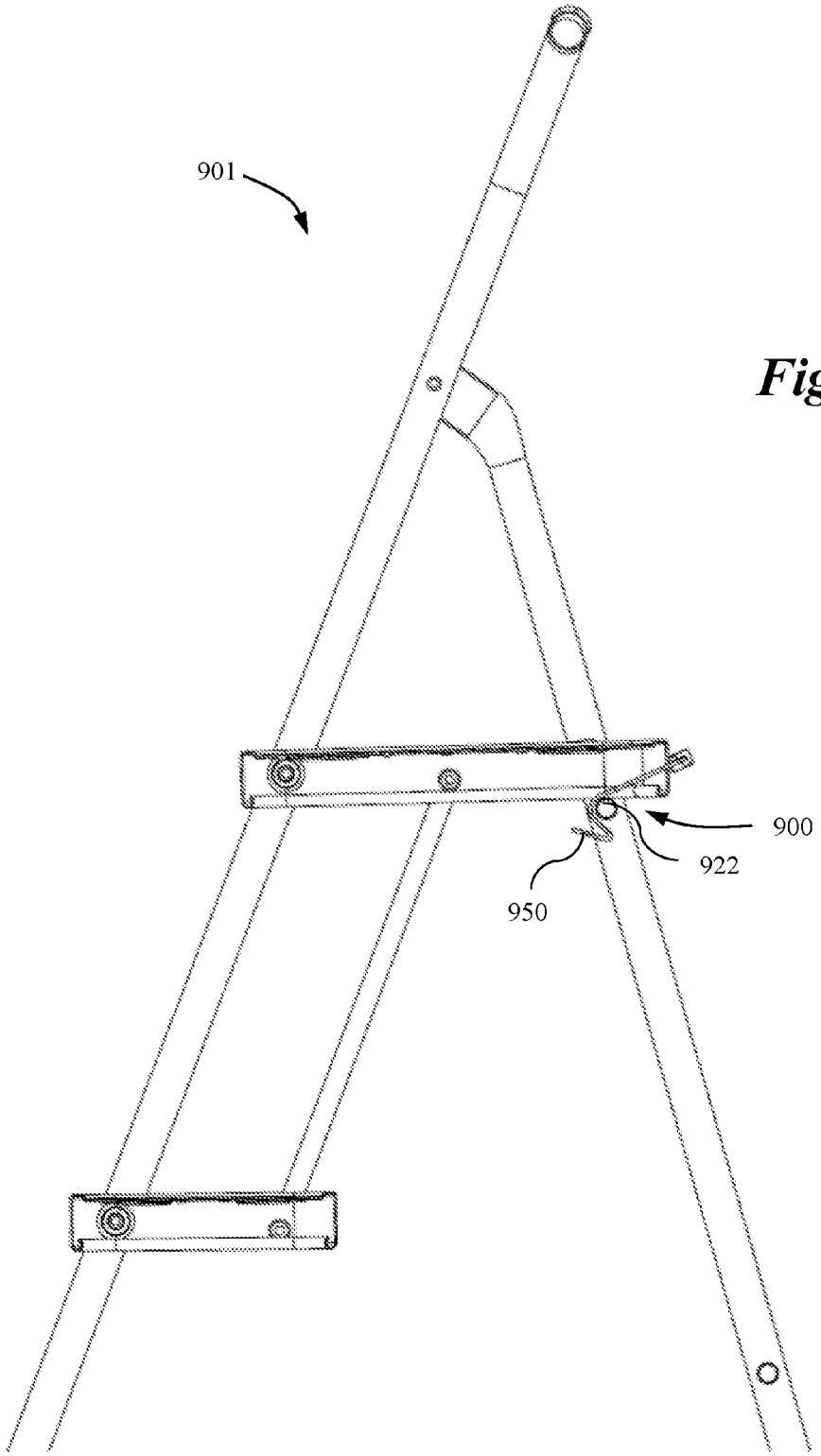
FIG. 14 is a side view of the step stool shown in FIG. 13 showing the latch in the locked position.

FIG. 12 details the step 914 with a handle 910 of the present invention. Advantageously, the back edge 915 of step 914 projects outward to create a handle 910. This is advantageous since the user can manipulate the step 914 with the handle 910. This handle 910 greatly reduces the frustration with folding and opening up the ladder FIGS. 9-14 detail the improved latch 900 of the present invention. The latch 900 includes a tail 950 extending from the second end 930. The tail 950 extends away from the hook 960 so as to not interfere with how the hook 960 engages the cross member 922. Preferably, the latch 900 is constructed of a single piece of flat sheet metal. The addition of the tail 950 allows the latch 900 to engage the cross member 922 more effectively than prior art latches and allows the latch 900 and stool 901 to be constructed with decreased tolerances and provide better performance. Another improvement contemplated by the present invention is the angling of the longitudinal axis of 980 of the first end 920 of the latch 900 from the latch's longitudinal axis 990. This angling eliminates the necessity of tabs found in the prior art latches to maintain the position of the latch 900 in the opening 905 of the stool 901.

It is to be understood that the above description is intended to be illustrative, and not restrictive. Many other embodiments will be apparent to those of skill in the art upon reviewing the above description. The scope of the invention should, therefore, be determined with reference to the appended claims, along with the full scope of equivalents to which such claims are entitled. With regard to the above detailed description, like reference numerals used therein may refer to like elements that may have the same or similar dimensions, materials, and configurations. While particular forms of embodiments have been illustrated and described, it will be apparent that various modifications can be made without departing from the spirit and scope of the embodiments herein. Accordingly, it is not intended that the invention be limited by the forgoing detailed description.

Various modifications to the embodiments of the inventions may be apparent to one of skill in the art upon reading this disclosure. For example, persons of ordinary skill in the relevant art will recognize that the various features described for the different embodiments of the inventions can be suitably combined, un-combined, and re-combined with other features, alone, or in different combinations, within the spirit of the invention. Likewise, the various features described above should all be regarded as example embodiments, rather than limitations to the scope or spirit of the inventions. Therefore, the above is not contemplated to limit the scope of the present inventions.

Persons of ordinary skill in the relevant arts will recognize that the inventions may comprise fewer features than illustrated in any individual embodiment described above. The embodiments described herein are not meant to be an exhaustive presentation of the ways in which the various features of the inventions may be combined. Accordingly, the embodiments are not mutually exclusive combinations of features; rather, the inventions may comprise a combination of different individual features selected from different individual embodiments, as understood by persons of ordinary skill in the art.

We claim:

1. A ladder comprising:

a first frame member;

a second frame member further including a cross member;

at least one step pivotally attached to the first frame member having a back edge with an opening therein, the at least one step supported by the cross member of the second frame member; and a latch pivotally attached to the at least one step, wherein the latch is adapted to fit within the opening in the step, the latch having a first end and a second end, the second end which releasably engages the cross member and the second end having a tail extending therefrom, wherein the latch further includes a longitudinal axis extending along a plane and the first end of the latch includes a longitudinal axis extending along the plane, the longitudinal axis of the first end being offset from the longitudinal axis of the latch.

2. The ladder of claim 1 wherein the latch further comprises a knob positioned on the first end of the latch.

3. The ladder of claim 2 wherein the knob is positioned on the back edge of the at least one step.

4. The ladder of claim 2 wherein the latch is formed of a single piece of sheet metal.

5. The ladder of claim 2 wherein a portion of the latch between the first end and the second end pivots around on an opening in the step.

6. The ladder of claim 1 further comprising steps, at least one of the steps is provided with a handle.

7. The ladder of claim 1 further wherein the second frame member has approximately the same width as the first frame member.

8. The ladder of claim 7 further wherein the ladder may be collapsed for storage, the second frame member folding to a position within a width of the first frame member.

9. The ladder of claim 1 wherein the ladder may be collapsed for storage, the second frame member folding to a position within a width of the first frame member.

10. The ladder of claim 1 wherein a portion of the latch pivots around on an opening in the step.

11. The ladder of claim 1, wherein the latch is gravitationally operable.

12. A ladder comprising:

a first frame member;

a second frame member further including a cross member;

at least one step pivotally attached to the first frame member having a back edge with an opening therein, the at least one step supported by the cross member of the second frame member; and a member latching the ladder in an open position, wherein the member is pivotally mounted to the at least one step and includes a first end and a second end, the second end which releasably engages the cross member and the second end having a tail extending therefrom, wherein the member further includes a longitudinal axis extending along a plane and the first end of the member includes a longitudinal axis extending along the plane, the longitudinal axis of the first end being offset from the longitudinal axis of the member.

13. The ladder of claim 12 wherein the member is enabled from a position on the back edge of the at least one step.

14. A step stool comprising:

a first frame member;

a second frame member further including a cross member;

at least one step pivotally attached to the first frame member, the at least one step supported by the cross member of the second frame member; and a latch pivotally attached to a back edge of the at least one step, the latch having a first end, a second end which releasably engages the cross member and the second end having a tail, wherein the latch further includes a longitudinal axis extending along a plane and the first end of the latch includes a longitudinal axis extending along the plane, the longitudinal axis of the first end being offset from the longitudinal axis of the latch.

15. The step stool of claim 14 wherein the latch further comprises a first end, the latch further comprises a knob positioned on the first end of the latch, the knob positioned on a back edge of the at least one step.

16. The ladder of claim 15 wherein the latch is formed of a single piece of sheet metal.

17. The step stool of claim 14 wherein the at least one of step further comprises a handle.

18. The step stool of claim 14, wherein the latch is gravitationally operable.

* * * * *